United States Patent [19]

Abplanalf

[11] Patent Number: 5,018,647

[45] Date of Patent: May 28, 1991

[54] DISPENSING CAP FOR USE WITH PRESSURIZED CONTAINER

[76] Inventor: Robert H. Abplanalf, 10 Hewitt Ave., Bronxville, N.Y. 10708

[21] Appl. No.: 547,399

[22] Filed: Jul. 3, 1990

Related U.S. Application Data

[63] Continuation of Ser. No. 388,729, Aug. 1, 1989, abandoned, which is a continuation of Ser. No. 277,540, Jan. 28, 1988, abandoned, which is a continuation of Ser. No. 861,114, May 6, 1986, abandoned, which is a continuation of Ser. No. 385,764, Jun. 8, 1982, abandoned.

[51] Int. Cl.[5] ..... B65D 83/00

[52] U.S. Cl. ..... 222/108; 222/402.13; 222/402.15; 222/402.21; 222/509; 239/526

[58] Field of Search ..... 222/108, 182, 402.13, 222/402.15, 402.21, 402.22, 472, 505, 509; 239/378, 526

[56] References Cited

U.S. PATENT DOCUMENTS

| | | | |
|---|---|---|---|
| Re. 24,555 | 10/1958 | Abplanalp . | |
| 211,559 | 7/1968 | Pizurro . | |
| 1,378,481 | 5/1921 | Mobley . | |
| 1,988,637 | 1/1935 | Tinkham . | |
| 1,988,979 | 1/1935 | Campbell . | |
| 2,351,376 | 6/1944 | Ward . | |
| 2,646,192 | 7/1953 | Gronmeyer . | |
| 2,664,266 | 12/1953 | Johnson . | |
| 2,697,635 | 12/1954 | Ivins et al. . | |
| 2,706,660 | 4/1955 | Johnson et al. | 222/108 X |
| 2,765,965 | 10/1956 | Reswick . | |
| 2,803,383 | 8/1957 | Dickman et al. . | |
| 2,820,578 | 1/1958 | Dickman . | |
| 2,831,608 | 4/1958 | Soffer et al. . | |
| 2,865,540 | 12/1958 | Gray . | |
| 2,868,421 | 1/1959 | Schott . | |
| 2,884,166 | 4/1959 | Vosbikian et al. . | |
| 2,887,273 | 5/1969 | Anderson et al. . | |
| 2,908,479 | 10/1959 | Goodspeed, Jr. . | |
| 3,039,654 | 6/1962 | Lopatka et al. . | |
| 3,089,625 | 5/1963 | Sorber et al. . | |
| 3,096,002 | 7/1963 | Focht . | |
| 3,101,876 | 8/1963 | Ayres . | |
| 3,107,826 | 10/1963 | Kruck . | |
| 3,116,856 | 1/1964 | Prussin et al. . | |
| 3,137,414 | 6/1964 | Steinkamp . | |
| 3,137,885 | 6/1964 | Hulsh . | |
| 3,138,331 | 6/1964 | Kutik . | |
| 3,139,223 | 6/1964 | Kruck . | |
| 3,140,014 | 7/1964 | Lerner . | |
| 3,143,254 | 8/1964 | Vanderhyde | 222/402.15 X |
| 3,149,757 | 9/1964 | Safianoff . | |
| 3,170,606 | 2/1965 | Boyer . | |
| 3,185,349 | 5/1965 | Sagarin . | |
| 3,189,232 | 6/1965 | Joffe . | |
| 3,211,304 | 10/1965 | Seaquist | 222/402.13 X |
| 3,211,384 | 10/1965 | Seaquist . | |
| 3,225,966 | 12/1965 | Sagarin . | |
| 3,233,783 | 2/1966 | Thornton . | |
| 3,237,809 | 3/1966 | Daragan et al. . | |
| 3,240,397 | 3/1966 | Sagarin | 222/182 |
| 3,249,267 | 5/1966 | Carrion, Jr. et al. . | |

(List continued on next page.)

FOREIGN PATENT DOCUMENTS

| | | |
|---|---|---|
| 2519108 | 4/1975 | Fed. Rep. of Germany . |
| 1003832 | 3/1947 | France . |
| 1481534 | 5/1966 | France . |
| 1512794 | 12/1967 | France . |

(List continued on next page.)

*Primary Examiner*—Andres Kashnikow
*Assistant Examiner*—Gregory L. Huson
*Attorney, Agent, or Firm*—William F. Kilgannon

[57] ABSTRACT

Dispensing cap for pressurized containers having a slotted housing adapted to fit onto the bead formed between the valve closure and the top of a pressurized container, an actuator disposed within the slotted housing and hinged thereto, the actuator defining a product discharge path and adapted to sealingly communicate with the valved closure of the container, and a trigger member affixed to the actuator and hinged to the housing, the hinged actuator and trigger providing a single or multiple-actuator lever structure, respectively, for the delivery of product from the valved container.

13 Claims, 4 Drawing Sheets

U.S. PATENT DOCUMENTS

| | | | |
|---|---|---|---|
| 3,260,416 | 7/1966 | Abplanalp . | |
| 3,282,471 | 11/1966 | Lehmann . | |
| 3,283,963 | 11/1966 | Boyer et al. . | |
| 3,289,949 | 12/1966 | Roth . | |
| 3,312,723 | 4/1967 | Anderson et al. . | |
| 3,314,576 | 4/1967 | Focht et al. . | |
| 3,317,092 | 5/1967 | Jurasek . | |
| 3,323,686 | 6/1967 | Roth . | |
| 3,329,320 | 7/1967 | Braun . | |
| 3,330,447 | 7/1967 | Doblin . | |
| 3,404,814 | 10/1968 | Wakeman . | |
| 3,429,484 | 2/1969 | Baldwin . | |
| 3,469,746 | 9/1969 | Melocchi . | |
| 3,478,935 | 11/1969 | Brooks . | |
| 3,501,066 | 3/1970 | Andreoli . | |
| 3,506,159 | 4/1970 | Muller . | |
| 3,515,316 | 6/1970 | Green . | |
| 3,540,634 | 11/1970 | Mayercik . | |
| 3,558,019 | 1/1971 | Hug et al. . | |
| 3,580,432 | 5/1971 | Brooks | 222/402.13 |
| 3,583,607 | 6/1971 | Beck | 222/402.21 |
| 3,602,399 | 8/1971 | Litman et al. . | |
| 3,625,403 | 12/1971 | Rousselot . | |
| 3,635,372 | 1/1972 | Van Dyck et al. . | |
| 3,659,791 | 5/1972 | Clark . | |
| 3,680,738 | 8/1972 | Vos et al. . | |
| 3,682,355 | 8/1972 | Lo . | |
| 3,698,604 | 10/1972 | Nigro . | |
| 3,704,311 | 12/1972 | Harden, Jr. . | |
| 3,734,357 | 5/1973 | Batistelli et al. . | |
| 3,739,941 | 6/1973 | Ostrwosky et al. . | |
| 3,887,115 | 6/1975 | Petterson . | |
| 3,946,911 | 3/1976 | Morane et al. . | |
| 3,987,942 | 10/1976 | Morane et al. | 222/402.15 |
| 4,040,543 | 8/1977 | Guillen . | |
| 4,077,548 | 8/1978 | Beard . | |
| 4,077,549 | 3/1978 | Beard . | |
| 4,098,436 | 7/1978 | Kohlbeck . | |
| 4,111,338 | 9/1978 | Cheng et al. . | |
| 4,138,039 | 2/1979 | Micallef . | |
| 4,141,471 | 2/1979 | Nozawa et al. . | |
| 4,157,774 | 6/1979 | Micallef | 222/402.15 X |
| 4,186,855 | 2/1980 | Edman et al. . | |
| 4,264,038 | 4/1981 | Nozawa . | |
| 4,278,187 | 7/1981 | Luedtke . | |

FOREIGN PATENT DOCUMENTS

| | | | |
|---|---|---|---|
| 2394467 | 6/1977 | France . | |
| 2403596 | 9/1977 | France . | |
| 437925 | 7/1948 | Italy . | |
| 6609055 | 2/1968 | Netherlands . | |
| 8100997 | 4/1981 | PCT Int'l Appl. . | |
| 573568 | 6/1972 | Switzerland . | |
| 1057353 | 2/1967 | United Kingdom . | |
| 1141968 | 2/1969 | United Kingdom | 222/193 |
| 1274976 | 4/1970 | United Kingdom . | |

DISPENSING CAP FOR USE WITH PRESSURIZED CONTAINER

This is a continuation of copending application(s) Ser. No. 07/388,729 filed on Aug. 1, 1989, now abandoned, which is a continuation of Ser. No. 07/277,540 filed on Jan. 28, 1988 now abandoned, which is a continuation of Ser. No. 06/861,114 filed on May 6, 1986 now abandoned, which is a continuation of Ser. No. 06/385,764 filed on Jun. 6, 1982 now abandoned.

BACKGROUND OF THE INVENTION

Pressurized containers of the aerosol type have been traditionally equipped with an actuating button or cap, which button or cap defines a product duct through which the product passes to the discharge orifice situated within the button or cap. To discharge product from the container, the user grasps the container and with one finger of the grasping hand depresses the button or a portion of the cap to release the contents of the container.

While achieving substantial commercial success, finger actuated buttons or caps have the disadvantage of inducing finger fatigue for some users. Moreover, with the prior systems of actuation, the aiming of the discharged product to the desired surface area suffers somewhat due to the relatively awkward gripping and finger placement. A more natural grasping and actuation of the container is achieved through the use of a trigger mechanism.

Heretofore, aerosol containers actuated through a trigger mechanism have had the disadvantages of not optimizing the ease of valve actuation; of having a portion of the actuating mechanism extend beyond the perimeter of the container, with the attendant problems during shipment or storage of preactuation due to inadvertent contact with the trigger; and aesthetic unappeal to consumers. Examples of prior trigger actuated aerosol containers are disclosed in U.S. Pat. Nos. 3,189,232, 3,580,432 and 3,987,942.

SUMMARY OF INVENTION

The dispensing cap of this invention is compact and aesthetically pleasing. Broadly, the actuator cap of this invention comprises a housing member having a base portion for fitment onto the valved closure portion of an aerosol or pressurized container, an actuator member having a valve-connecting and discharge portions with a product flow path therebetween, said actuator being hingedly mounted to the housing, preferably diametrically opposite to the discharge end of the actuating member, and a trigger member attached to the actuating member proximate and substantially perpendicular to the discharge orifice. A further feature of a more specific aspect of the cap of this invention, is the achievement of the ease of actuation through utilization of a multiple lever mechanism.

According to this invention, the cap has a housing which mounts onto the bead of the container formed between the opening in the container and the valved closure, said valved closure normally referred to as a mounting cup. Disposed within the housing and hinged thereto, is an actuating member which defines a product flow duct. The actuating member has a vertical portion which sealingly connects with the discharge side of the valve in the valved closure and a horizontal portion which terminates in a discharge orifice; the product duct within the actuating member being in communication with the duct or passage on the discharge side of the valve to thereby provide a closed duct, or passage, flowing product to the discharge orifice. By hinging the actuating member to the housing, preferably diametrically opposite to the discharge end of the actuating member, a first lever is established having an applied force arm from the hinge to the point of application of working pressure on the actuating member which is of greater length than the working arm from the hinge to that portion of the actuating member which contacts and depresses (opens) the valve.

Further, a trigger member is mounted on the horizontal portion of the actuating member, which trigger member extends downwardly and substantially perpendicular to the horizontal portion of the actuating member. In a more specific form of the invention, rearwardly of the mounting or contacting position relative to the discharge end of the actuator, the trigger member is hinged to the housing to provide a second lever. In the second lever the applied force arm comprising the distance from the hinge point of the trigger member to the contacting point of trigger and actuator member, (whereat the trigger may apply a downward force on the horizontal portion of the actuator), is greater than the work arm comprising the distance from the trigger engagement of the discharge portion to the actuator through the trigger hinge. Thus, the cap of this invention is actuated with the cummulative mechanical advantage supplied by the combination of first and second levers.

The invention will be further explained by reference to the accompanying drawings in which.

Figure 1:
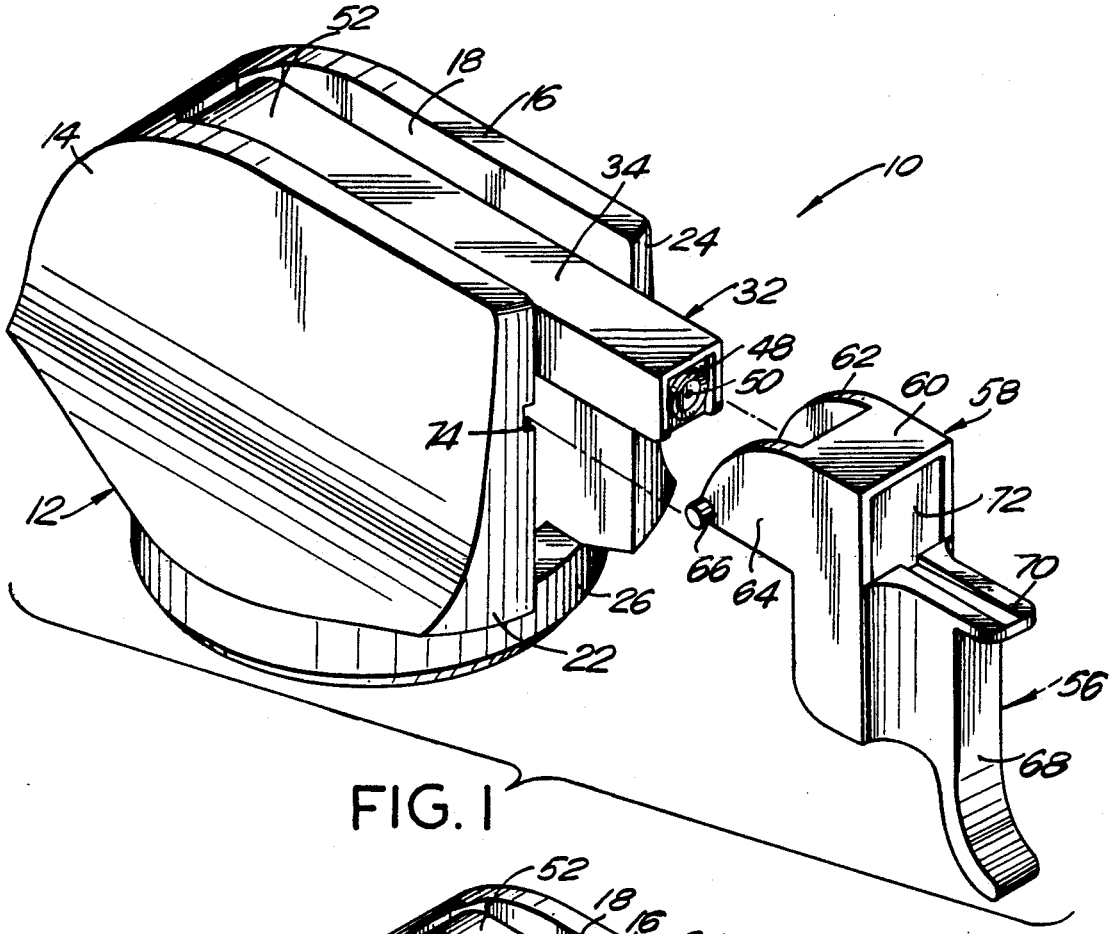
FIG. 1 is a schematic view of the dispensing cap of this invention with the trigger member dismounted but aligned for mounting onto the cap.
Figure 2:
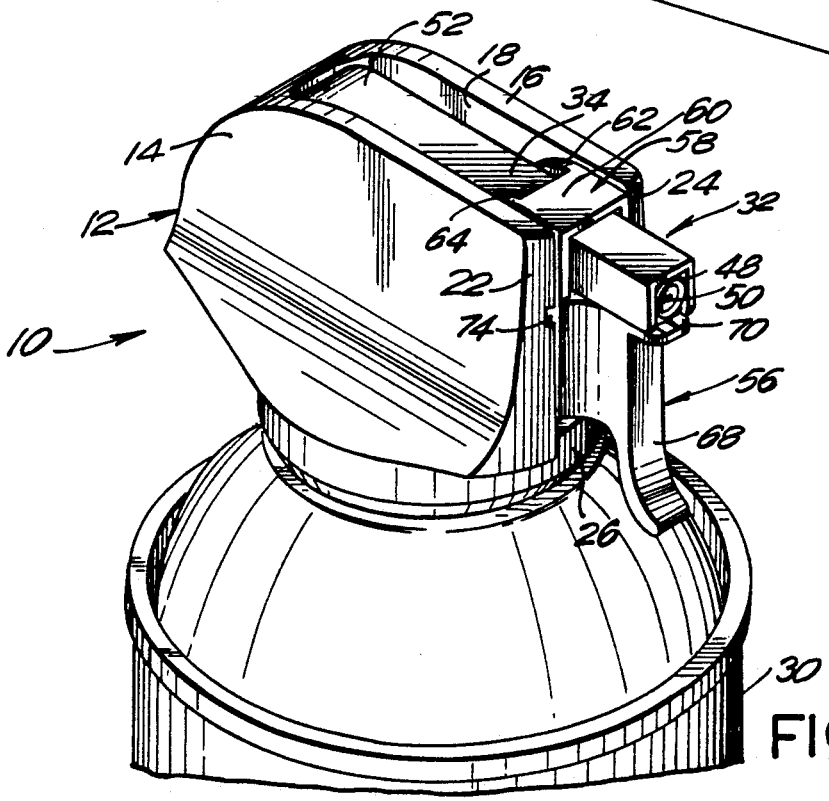
FIG. 2 is a schematic view of the dispensing cap of this invention with the trigger member in mounted position.
Figure 3:
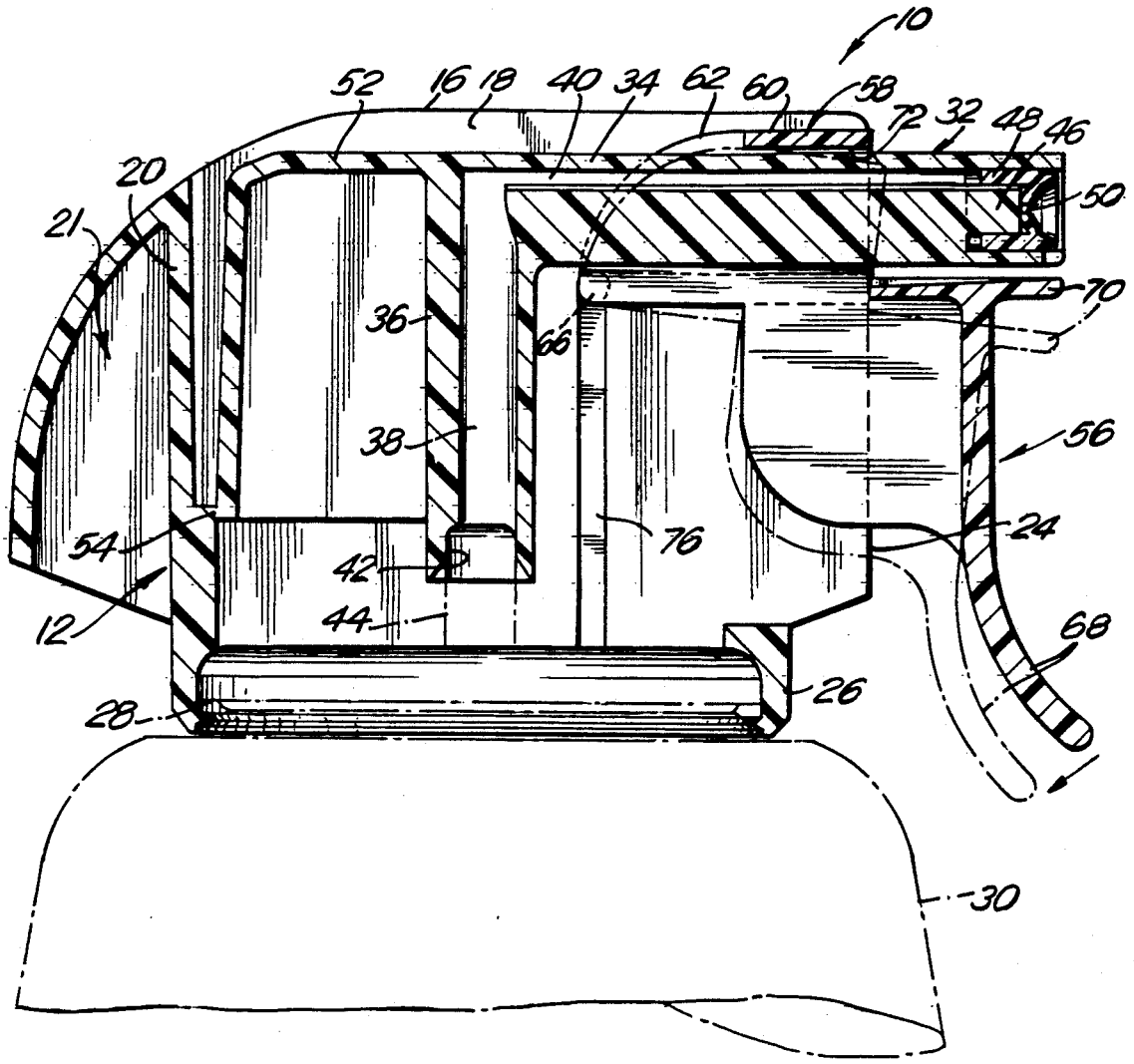
FIG. 3 is an axial sectional view of the cap of this invention mounted on the bead formed by the mounting cup and the structure defining the container opening; showing also in dotted form the trigger in depressed or valve open position.
Figure 4:
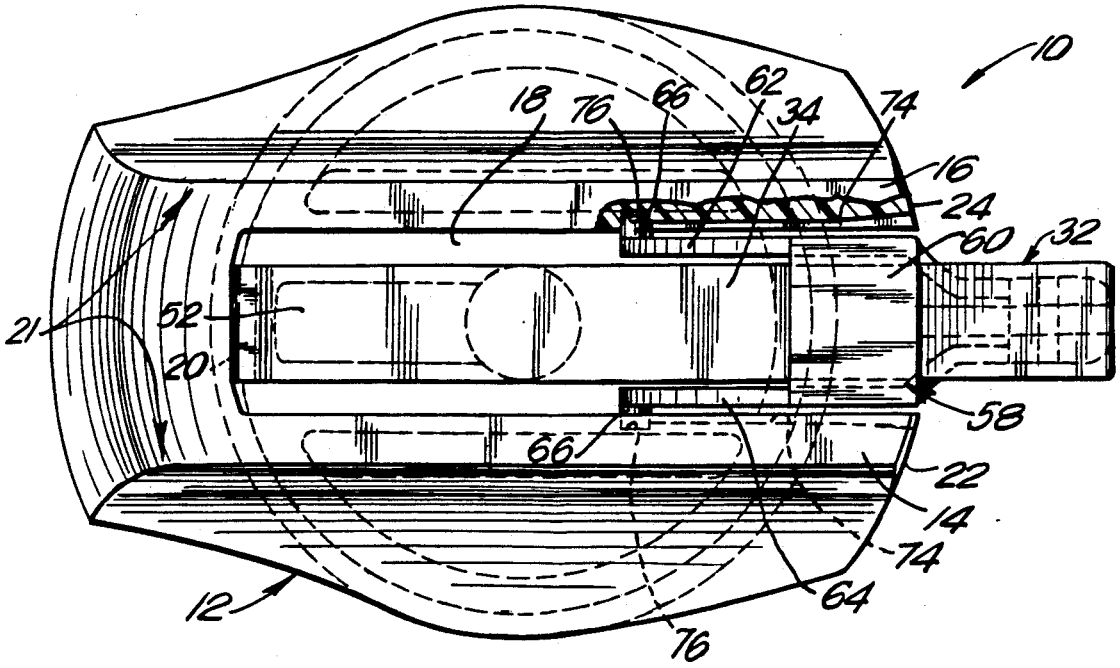
FIG. 4 is a top view of the dispensing cap with a partial section of the aligning grooves and positioning recess for inserting and affixing the trigger member to its final position.
Figure 5:
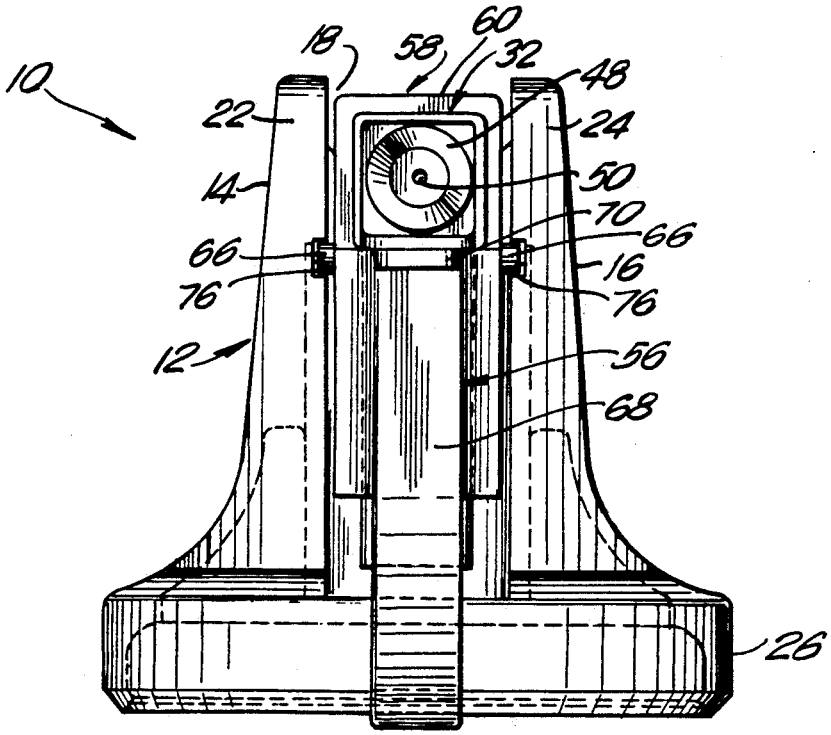
FIG. 5 is a front elevation view of the dispensing cap.

Referring to FIGS. 1–3, the dispensing cap of this invention is generally designated as 10. The cap comprises a housing, generally designated as 12, having hollow side walls 14 and 16 defining a slot 18, a vertical wall 20 and front walls 22 and 24, which further define slot 18. Side walls 14 and 16 of the housing 12 have at their lower end a circular flange 26 which is adapted, in conventional manner, to snap-fit over the conventional bead formed by joining the mounting cup 28, shown in schematic in FIG. 3, of a pressurized container 30, (shown in partial schematic in FIGS. 2 & 3) with the container. Extending outwardly from vertical wall 20 are the rear panels, generally designated as 21.

An actuator member, generally designated as 32, is disposed within the slot 18 of the housing 12. The actuator member 32, has a horizontal portion 34 and a vertical portion 36. Through the vertical portion 36 of the actuator member 32 is a duct 38, which is continued in the horizontal portion 34 as duct 40. At one end of the vertical portion 36 of the actuator member 32 is a valve stem receiving socket 42 which defines a recess to receive the valve stem 44 of a conventional valved pressurized container. Terminating one end of the horizontal portion 34 of the actuator member 32 is a post 46 adapted to receive an insert 48 having a discharge orifice 50.

The post 46 and insert 48 may be of any type known in the aerosol spray container field, preferably a discharge system employing a series of ducts leading to the discharge orifice commonly referred to as a "swirl chamber".

Extending from the joinder of the horizontal portion 34 and the vertical portion 36 of the actuator member 32 is hinge arm 52, which arm 52 terminates in a hinge 54. The hinge arm 52 is preferably joined to the housing at its terminus distil to the vertical portion 36.

Preferably, the housing 12 and actuator member 32 are molded of plastic and in one-piece, the hinge 54 being molded integral to the housing 12.

When actuating an aerosol valve of the vertical acting type (known to those skilled in the art), it is desirable that the travel path traversed by the movement of the actuator member during opening of the valve be as near as possible to that of the valve stem, namely, vertical. To achieve this valve opening direction for the actuator movement, the hinging of the actuator and housing is set at an elevation coincident with the top of the valve stem, and more preferably at the midpoint of the travel distance of the valve stem during actuation.

The trigger member, generally designated as 56, and shown best in FIG. 1, has a yoke portion, generally designated as 58, having a top plate 60 and side walls 62 and 64. On both side walls 62 and 64 are lugs 66. The trigger member has a finger receiving portion 68, atop of which is a grooved plate 70. The yoke portion 58 defines an opening 72, which is dimensioned such that the yoke portion 58 slides over the horizontal portion 34 of the actuator member 32 through opening 72.

The grooved plate 70 is an additional feature of this invention useful to provide a catch channel for any dripping of product after the valve has been closed. Product dripping onto the plate 70 passes along the groove and within the confines of the dispensing cap rather than drip onto the outside of the container or the user's hand.

In mounting the trigger member 58 onto the actuator member 32, the lugs 66 are passed along grooves 74 on the inner surface of the hollow side walls 14 and 16, which grooves 74 are preferably flared slightly outwardly toward the discharge end of the actuator 32. The grooves 74 terminate in recesses 76 deeper than the inner terminal ends of the grooves 74, such that when the trigger member 58 is advanced to its ultimate position beyond the grooves 74, the lugs 66 snap into the recesses 76 and hold the trigger member 58 permanently in position. The recesses 76 are preferably located near the end of the discharge portion 34 of the actuator 32 distil to the discharge orifice 50. The trigger member 58 therefore preferably engages the horizontal portion 34 (discharge portion) of the actuator between the discharge orifice 50 and the vertical portion 36 (valve connecting portion).

As shown in FIG. 2 the front end of the yoke portion 58 terminates at the front walls 22 of the housing 12.

The lugs 66 act as a fulcrum for the trigger member, thereby effecting a second lever action when the trigger member 56 is moved toward the container.

Maximum lever action for the trigger member is effected by positioning the trigger hinge, as close as molding and assembly will permit, to the resisting pressure of the valve of the pressurized container and away from the contact between the trigger and actuator members.

In operation, moving the trigger toward the container will depress the actuator member and in turn the valve stem, thereby opening the valve of the container. The product is then discharged through ducts 38,40 to the "swirl chamber" at the discharge end of the horizontal portion 34 of the actuator member 32 and ultimately through the discharge orifice 50.

Figure 6:
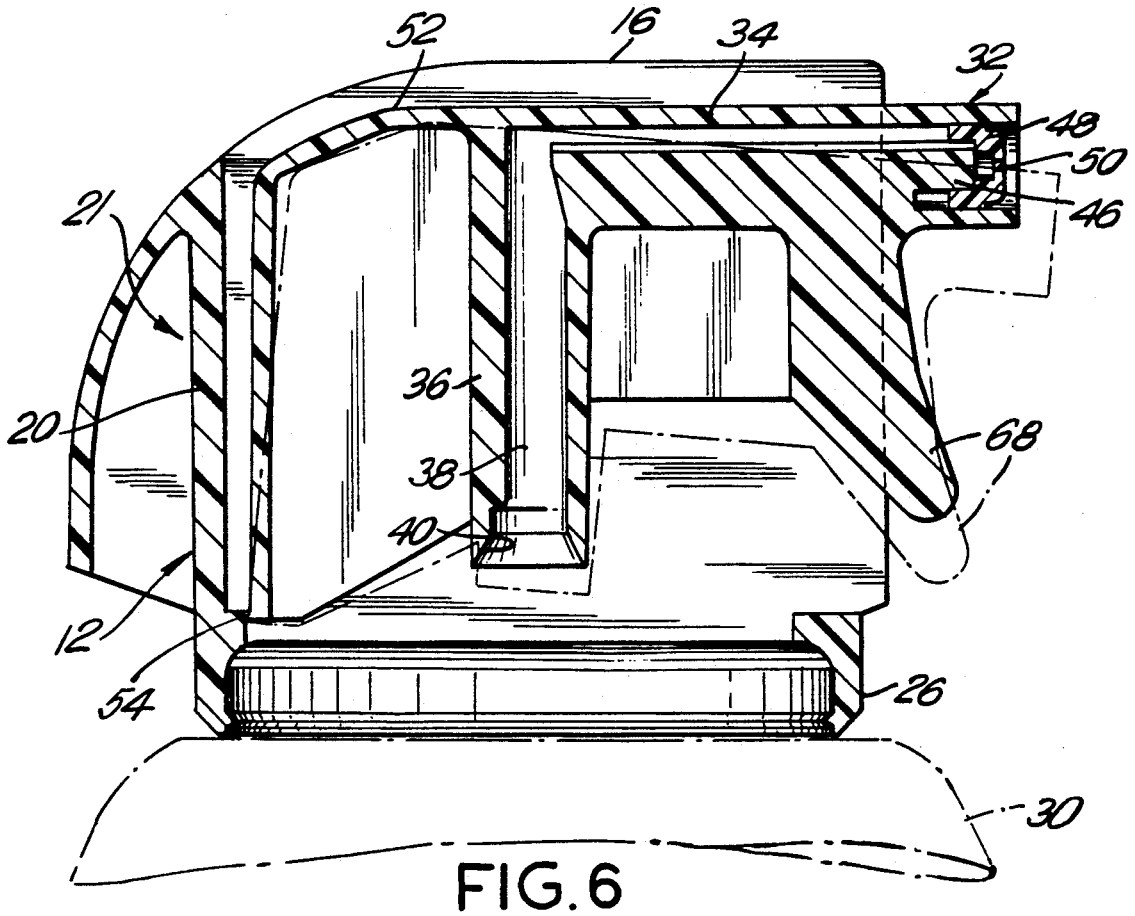
FIG. 6 is an axial sectional view of the cap of this invention mounted as in FIG. 3, but wherein the trigger member is molded integral to the actuating member.

FIG. 6 is an axial sectional view of the cap of this invention mounted as in FIG. 3, but wherein the trigger member 68 is molded integral to the actuating member. Corresponding parts between FIG. 6 and the other figures are numbered the same.

The position of the trigger and the actuator during actuation are shown in phantom. The actuator 32 has a valve-connecting portion 40 and a discharge portion 50. Trigger 68 is integral with and depends from the discharge portion 50 of the actuator 32. The actuator has a hinge arm 52 hingedly attached to the rear wall of the housing 54, providing a lever. The trigger 68 has its gripping area disposed outside of the housing but within the perimeter of the container. The trigger member 68 is substantially parallel to the valve connecting portion 36 of the actuator 32. The hinge 54 is disposed proximate to the radial plane extending from the terminus 40 of the valve connecting portion 36 of the actuator 32.

I claim:

1. A multi-levered trigger-actuated dispensing cap adapted for use with a pressurized container having a valved closure, said cap comprising:

(a) a slotted housing having rear and side walls and a base adapted to be mounted on the perimeter of the valve closure, (b) an actuator disposed within the slotted housing having a valve-connecting portion and a laterally directed discharge portion together defining a product duct, which actuator at the terminus of the valve-connecting portion sealingly connects with the valved closure and at the terminus of the discharge portion has a discharge orifice, said actuator further having a hinged arm hingedly connecting the actuator and housing to provide a lever, and (c) a manually-operated trigger member engaging the discharge portion of the actuator at a point between the discharge orifice and the valve connecting portion and being hinged to the slotted housing, said trigger member having its gripping area disposed outside of the housing but within the perimeter of the container that the dispensing cap is adapted to fit, said trigger member being hinged to the housing at a position such that the distance from the trigger gripping surface to the trigger hinge is greater than the distance from the trigger engagement of the discharge portion of the actuator to the trigger hinge, thereby providing a second lever.

2. The dispensing cap of claim 1, and further wherein the engagement between the trigger member and the laterally directed discharge portion of the actuator is positioned within the slotted housing.

3. The dispensing cap of claim 2, and further wherein the trigger member is hinged to the side walls of the housing near the end of the discharge portion of the actuator distal to the discharge orifice.

4. The dispensing cap of claim 1, and further wherein the hinged arm of the actuator extends rearwardly and downwardly from the valve-connecting portion of the actuator, said hinged arm being joined to the housing to form a hinge at its terminus distal to the valve-connecting portion.

5. The dispensing cap of claim 4, and further wherein the engagement between the trigger member and the laterally directed discharge portion of the actuator is positioned within the slotted housing.

6. The dispensing cap of claim 4, and further wherein the hinged arm of the actuator is hinged to the rear wall of the housing.

7. The dispensing cap of claim 6, and further wherein the actuator is hinged to the rear wall of the housing radially outward from the terminus of the valve-connecting portion.

8. The dispensing cap of claim 1, and further wherein a grooved catch plate is disposed outwardly of and proximate to the discharge orifice of the actuator, the groove of said plate communicating with the interior of the cap housing.

9. A trigger-actuated dispensing cap adapted for use with a pressurized container having a valved closure, said cap comprising;

(a) a slotted housing having rear and side walls and adapted to be mounted on the perimeter of the valve closure, (b) an actuator disposed within the slotted housing having a valve-connecting portion and a laterally directed discharge portion together defining a product duct, the valve-connecting portion having a terminus for sealingly connecting with the valved closure and the discharge portion having a terminus with a discharge orifice said actuator further having a hinged arm hingedly connecting the actuator and the rear wall of the housing to provide a lever, and, (c) a manually operated trigger member affixed to the discharge portion of the actuator, having its gripping area disposed outside of the housing but within the perimeter of the container that the dispensing cap is adapted to fit.

10. The dispensing cap of claim 9, and further wherein the discharge portion of the actuator is substantially perpendicular to the valve-connecting portion.

11. The cap of claim 10, and further wherein the gripping area of the trigger is substantially parallel to the valve-connecting portion of the actuator.

12. The dispensing cap of claim 9, and further wherein the hinged arm extends rearwardly and downwardly from the valve-connecting portion of the actuator, said hinged arm being joined to the housing to form a hinge at its terminus distal to the valve-connecting portion.

13. The dispensing cap of claim 12, and further wherein the hinged arm is hinged to the rear wall of the housing radially outward from the terminus of the valve-connecting portion.

* * * * *